US007274301B1

(12) United States Patent
Smith et al.

(10) Patent No.: US 7,274,301 B1
(45) Date of Patent: Sep. 25, 2007

(54) ACCESS CONTROL DEVICE WITH ELECTRONIC IDENTIFICATION AND AUDIO COMMUNICATION CAPABILITY

(75) Inventors: Anthony David Smith, Marton (NZ); Nicholas Bernard Body, Palmerston North (NZ); Felix Anton Harold Collins, Palmerston North (NZ)

(73) Assignee: Cardax Int'l Limited, Martin (NZ)

( * ) Notice: Subject to any disclaimer, the term of this patent is extended or adjusted under 35 U.S.C. 154(b) by 0 days.

(21) Appl. No.: 09/890,893

(22) PCT Filed: Feb. 10, 2000

(86) PCT No.: PCT/NZ00/00010

§ 371 (c)(1),
(2), (4) Date: Nov. 9, 2001

(87) PCT Pub. No.: WO00/48150

PCT Pub. Date: Aug. 17, 2000

(30) Foreign Application Priority Data

Feb. 11, 1999 (NZ) ..... 334139

(51) Int. Cl.
*G08B 25/08* (2006.01)

(52) U.S. Cl. ..... 340/692; 235/382; 340/5.81

(58) Field of Classification Search ..... 340/692, 340/541, 543, 5.8–5.85; 379/167.01, 167.05, 379/167.14; 235/375, 380, 382, 382.5
See application file for complete search history.

(56) References Cited

U.S. PATENT DOCUMENTS

| | | | | | |
|---|---|---|---|---|---|
| 3,673,331 | A * | 6/1972 | Hair et al. | ..... | 704/246 |
| 4,074,250 | A * | 2/1978 | Cooper | ..... | 340/304 |
| 4,581,634 | A * | 4/1986 | Williams | ..... | 348/156 |
| 5,014,295 | A * | 5/1991 | Kunihiro | ..... | 455/463 |
| 5,541,585 | A * | 7/1996 | Duhame et al. | ..... | 340/541 |
| 5,565,857 | A * | 10/1996 | Lee | ..... | 340/5.8 |
| 5,737,393 | A * | 4/1998 | Wolf | ..... | 379/88.13 |
| 5,953,700 | A * | 9/1999 | Kanevsky et al. | ..... | 704/270.1 |
| 5,979,754 | A * | 11/1999 | Martin et al. | ..... | 235/382 |
| 6,091,826 | A * | 7/2000 | Laitinen et al. | ..... | 381/82 |
| 6,374,356 | B1 * | 4/2002 | Daigneault et al. | ..... | 713/200 |
| 6,405,032 | B1 * | 6/2002 | Buhrmann | ..... | 455/413 |
| 2002/0029349 | A1 * | 3/2002 | Daigneault et al. | ..... | 713/200 |

* cited by examiner

*Primary Examiner*—Thomas Mullen
(74) *Attorney, Agent, or Firm*—Sughrue Mion Pllc.

(57) ABSTRACT

An access control device including electronic identification device, the access control device characterized in that the access control device also includes an audio communication device.

11 Claims, 1 Drawing Sheet

ACCESS CONTROL DEVICE WITH ELECTRONIC IDENTIFICATION AND AUDIO COMMUNICATION CAPABILITY

This invention relates to improvements in control and/or monitoring systems.

Reference throughout the specification shall now be made to the present invention in relation to security systems which are in fact control and/or monitoring systems.

BACKGROUND ART

An increasing number of security systems are being installed world-wide. Further, existing security systems are continually being upgraded as technology becomes smarter, more monitoring/control devices are available, and the desire for increased security increases.

There is often a need to control access to a door or building by using an access control system that uses electronic means such as a token, badge or card to identify persons allowed access. Sometimes the means of electronic identification is a PIN number that a person is required to enter via a keyboard. Usually, with the appropriate identification is received, access is automatically granted.

For ease of reference the access control system will now be referred to as a card reader.

There a number of situations whereby the wrong identification is received, or no identification means is received at all. For example, a person may enter in the wrong PIN number, have an out of date identification device, may not have the identification device with them or may not have been provided with such a device in the first place.

In the above circumstances, it is desirable for that person to have audio communication with an operator of the security system. That operator can then determine whether access can be granted and subsequently either allow or deny that person access. This audio communication is typically supplied by a separate intercom device which usually is manufactured by a separate manufacturer from one who would normally manufacture the card reader.

This is obviously an undesirable situation.

As these devices are from separate manufacturers, there is no consistency in the data format. Thus, the devices do not normally share data between them and two separate communication networks are required to be run from the devices to the main security system.

Also, the devices are required to be installed separately and can take up considerable space in the process.

Further, it is not possible to have any interactions between the devices. For example, someone swiping their card does not have immediate access to intercom functions.

It can be seen that having separate devices means they are expensive to install and maintain because of the reproduction of components and cabling.

Thus it is the object of the present invention to address the above problems, or at least to provide the public with a useful choice.

SUMMARY OF THE INVENTION

According to one aspect of the present invention there is provided an access control device including an electronic identification means, characterised in that the access control device also includes an audio communications device.

DESCRIPTION OF THE PREFERRED EMBODIMENTS

Figure 1:
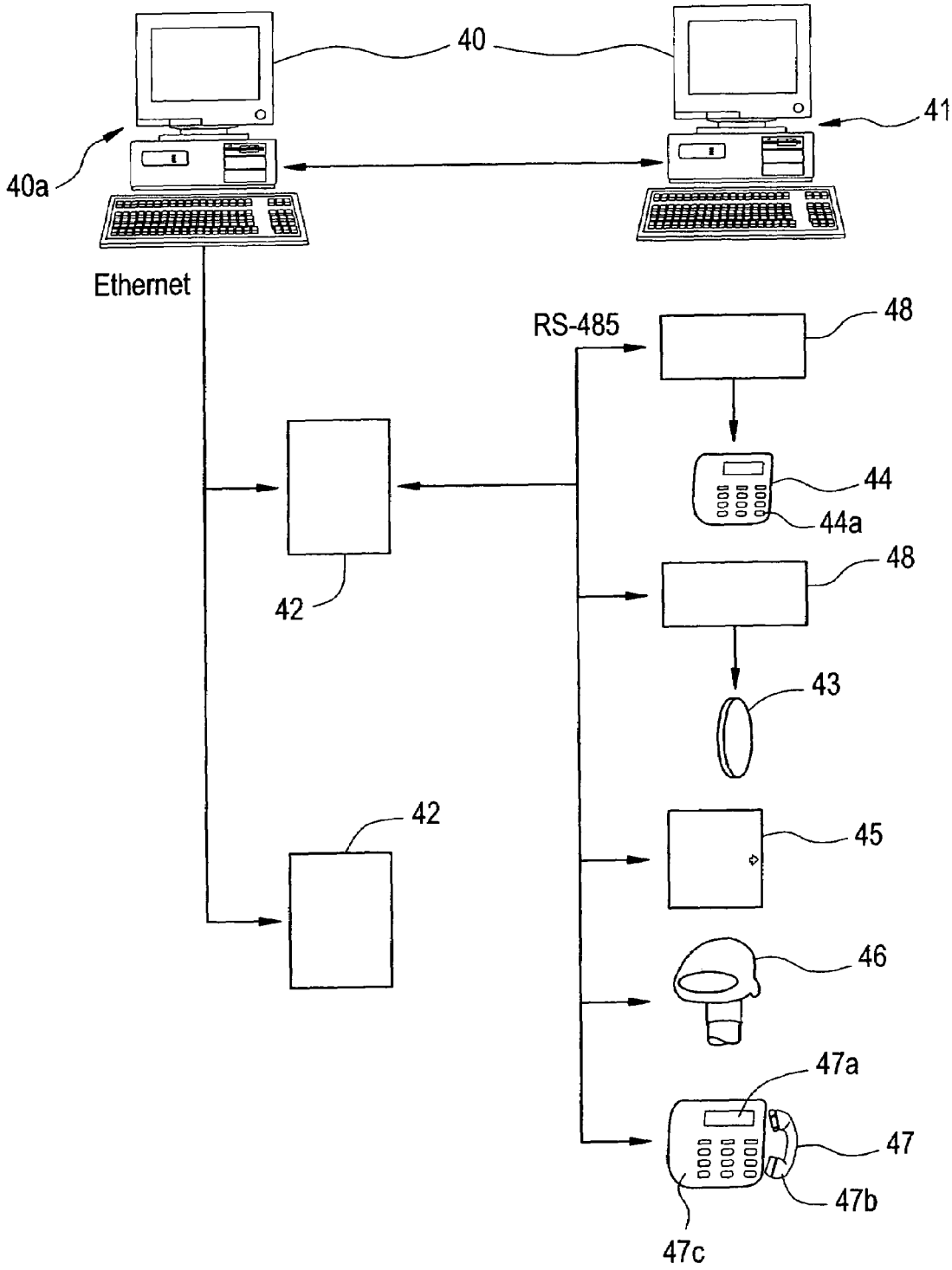
FIG. 1 is an illustration relevant to the present invention.

A basic system configuration of a control monitoring system to which the present invention applies is illustrated in the figure. The system includes a command center 40 that comprises a Server 40*a* and at least one work station 41. The server is coupled to at least one access controller 42 via an ethernet connection. The access controller has bi-directional links via a high speed RS 485 network to a plurality of peripherals, including field devices 48 that couple to magnetic step reading 43 or proximity reader 44.

The RS 485 network also couples an output panel 45, a digital video camera (DVC) 46 or an intercom 47 to the access controller 42. An output panel 45, also connects to the network.

According to further aspect of the present invention there is provided a control and/or monitoring system which incorporates an access control device as described above.

According to a further aspect of the present invention there is provided a method of installing a control and/or monitoring system characterised by the step of installing an access control device as described above.

Reference throughout the specification should now be made to the access control device 43, 44, 45, 46, 47, 48 as being a 'plus reader'. It should be appreciated that this term is used for reference only and should not be seen as limiting.

The electronic identification means may come in a number of forms and may include a single component or a number of different components. For example, the electronic identification means may be a card reader 43/41. This may be in the form of a swipe card device 43, or perhaps in some embodiments a proximity smart card reader 44/48.

The electronic identification means may include a key pad 44A by means of which alpha/numeric or some other form of data can be entered. This may be in addition to or instead of a card reader.

In preferred embodiments the key pad has back lighting so that it can be read in the dark.

Other embodiments of the present invention may have the electronic identification means remotely sense some physical attribute of the person wishing to gain access. For example, it may use a fingerprint or retina scan or other biometric devices.

In further embodiments of the present invention the audio communications device would be in the form of an intercom 47 and will be referred to as such throughout the specification. Again this term should not be seen in any way as limiting.

Preferably, the person situated by the plus reader can press a function key to operate the intercom 47 and communicate with the operator of the security system.

Preferably also, the operator can communicate back through the intercom 47.

In some embodiments of the present invention the operator can choose when to turn on the intercom 47. For example, in the area close to the plus reader there may be evidence of an alarm or duress situation such as screaming. The operator can then turn on the intercom and listen to this sound.

In some embodiments, the operator may also record any of the audio.

The intercom 47 may also be able to provide other audio services. For example, an intercom may play pre-stored audio clips to the user. For example, the user may swipe the card and the security system may determine that there is a message waiting for that particular user. This message may be retrieved from whatever storage system in which it is kept and played for the user.

The intercom 47 may also be able to play emergency evacuation audio clips. For example, 'Fire, please exit immediately through exit door'.

In some embodiments the present invention the plus reader may also include a display which may also display messages. In preferred embodiments, the display is a graphical LCD display with back lighting.

The intercom 47 may also be used as part of a paging system.

While the data from the intercom 47 may be in any suitable format that can be used in any security system, it is preferably in digital format. This allows for easier integration with other data received through the security system and other peripheral devices and for interaction with the electronic identification means. The digital data is also easier to store and process.

In some embodiments of the present invention, the data from the intercom may be compressed which allows for easier transmission and the use of a smaller bandwidth communication system.

It is envisaged that the person at the card reader will generate an event or signal when pressing a designated function key on the reader that includes the intercom. This event or signal may be recorded by the security system as well as alerting the operator of the security system. While the operator is talking into or listening to the intercom the conversation may be optionally recorded to the operator's workstation or elsewhere.

In some embodiments, an occurrence of certain events can trigger the transmission of compressed audio data from the intercom such that the security system will have recorded a number of seconds of sound after the event. This means that the security system does not necessarily record sound from an intercom continuously, but only source sound from around the time of events that are of interest.

Data from the intercom 47 and the card reader 43/44 can be indexed to data received from other peripherals such as video cameras 46.

It should be appreciated that a number of technical issues need to be overcome to ensure that the communications system and the plus reader can handle the different data needs of the systems.

For example, a typical card reader only requires communications bandwidth of maybe 40K bits per second to perform normal access control functionality. However, to handle the communications from the intercom 47 and other peripheral devices such as a camera 46, the communications systems need at least four times that bandwidth. For example, in one particular embodiment of the present invention, the bandwidth of 187.5K bps is required.

The human ear is very sensitive to sound quality. It should also be appreciated that in the security system, sound quality is paramount, not only in communicating instructions, but also with recorded sound happening around an 'event'. Audio dropouts or loss in security systems is something to be avoided.

Thus, the applicants have in preferred embodiments of the invention designed a system that guarantees to poll each of plus readers 42 at a minimum of 10 times per second. This gives the audio quality desired.

It should now be appreciated that the present invention offers a number of advantages over the prior art.

The incorporation of an electronic identification such as card reader 43/44 along with an audio communications device such as an intercom 47 provides cost savings and several improvements of functionality.

Firstly, common installation costs are far cheaper as only one device has to be installed and one set of cabling as opposed to two.

Secondly, integration of data can be readily achieved with the two devices in the one unit. Audio information can be played to the card user which is directly linked to the identification of that particular card user.

Visual display of various messages combined with an audio display can be readily communicated to a card holder.

The operator of a security system can also provide integrated control functions and again readily communicate with the person positioned by the access control devices.

Data received by the access control device with the audio or identification data can be readily integrated.

With the embodiment of the present invention which uses digital intercom, data can be readily processed with digital data coming in from other peripheral devices such as video cameras 46.

Aspects of the present invention have been described by way of example and it should be appreciated that modifications and additions may be made thereto without departing from the scope of the appended claims.

The invention claimed is:

1. An access control device including:

electronic identification means, and an audio communications device, wherein the electronic identification means and the audio communications device are included in a single unit and are configured to use the same communications cable to control access to a physical area or region, and wherein the access control device can be activated or controlled by a remote operator.

2. An access control device as claimed in claim 1 wherein the electronic identification means is in the form of a card reader.

3. An access control device as claimed in claim 1 wherein the electronic identification means includes a key pad.

4. An access control device as claimed in claim 1 wherein the audio communications device is in the form of an intercom.

5. An access control device as claimed in claim 1 wherein the audio communications device includes the ability to play pre-stored audio clips.

6. An access control device as claimed in claim 1 wherein data shared between the electronic identification means and audio communications device is in a format that can be transmitted from the access control device over a single communications cable.

7. An access control device as claimed in claim 1 wherein the audio communications device is bi-directional.

8. A control system which incorporates an access control device as claimed in claim 1.

9. A method of installing a control system characterised by the step of installing an access control device as claimed in claim 1.

10. A monitoring system which incorporates an access control device as claimed in claim 1.

11. A method of installing a monitoring system characterised by the step of installing an access control device as claimed in claim 1.

* * * * *